US006693415B2

(12) United States Patent
Johnson

(10) Patent No.: US 6,693,415 B2
(45) Date of Patent: Feb. 17, 2004

(54) CURRENT SOURCE

(75) Inventor: Peter Johnson, Buckinghamshire (GB)

(73) Assignee: STMicroelectronics Ltd., Buckinghamshire (GB)

( * ) Notice: Subject to any disclaimer, the term of this patent is extended or adjusted under 35 U.S.C. 154(b) by 0 days.

(21) Appl. No.: 10/161,077

(22) Filed: May 31, 2002

(65) Prior Publication Data

US 2003/0001555 A1 Jan. 2, 2003

(30) Foreign Application Priority Data

Jun. 1, 2001 (EP) ..... 01304840

(51) Int. Cl.[7] ..... G05F 3/20
(52) U.S. Cl. ..... 323/313; 323/313; 323/314
(58) Field of Search ..... 323/313, 314, 323/315, 316; 327/538, 560, 576

(56) References Cited

U.S. PATENT DOCUMENTS 4,626,770 A * 12/1986 Price, Jr.
5,063,342 A * 11/1991 Hughes et al. ..... 323/315
5,581,174 A * 12/1996 Fronen ..... 323/316
5,629,611 A * 5/1997 McIntyre ..... 323/313
5,783,937 A * 7/1998 Perraud ..... 323/315
6,016,051 A 1/2000 Can ..... 323/315
6,087,820 A 7/2000 Houghton et al. ..... 323/315

FOREIGN PATENT DOCUMENTS

EP 0 656 575 A1 6/1995

* cited by examiner

*Primary Examiner*—Rajnikant B. Patel
(74) *Attorney, Agent, or Firm*—Lisa K. Jorgenson; Robert Iannucci; Seed IP Law Group PLLC

(57) ABSTRACT

A current source using a bandgap voltage circuit includes a current gain circuit between the output of the bandgap circuit and the current output transistor. On-off control is provided by a switchable bias circuit providing an ON potential to start the bandgap and a clamping circuit opening the feedback loop.

23 Claims, 1 Drawing Sheet

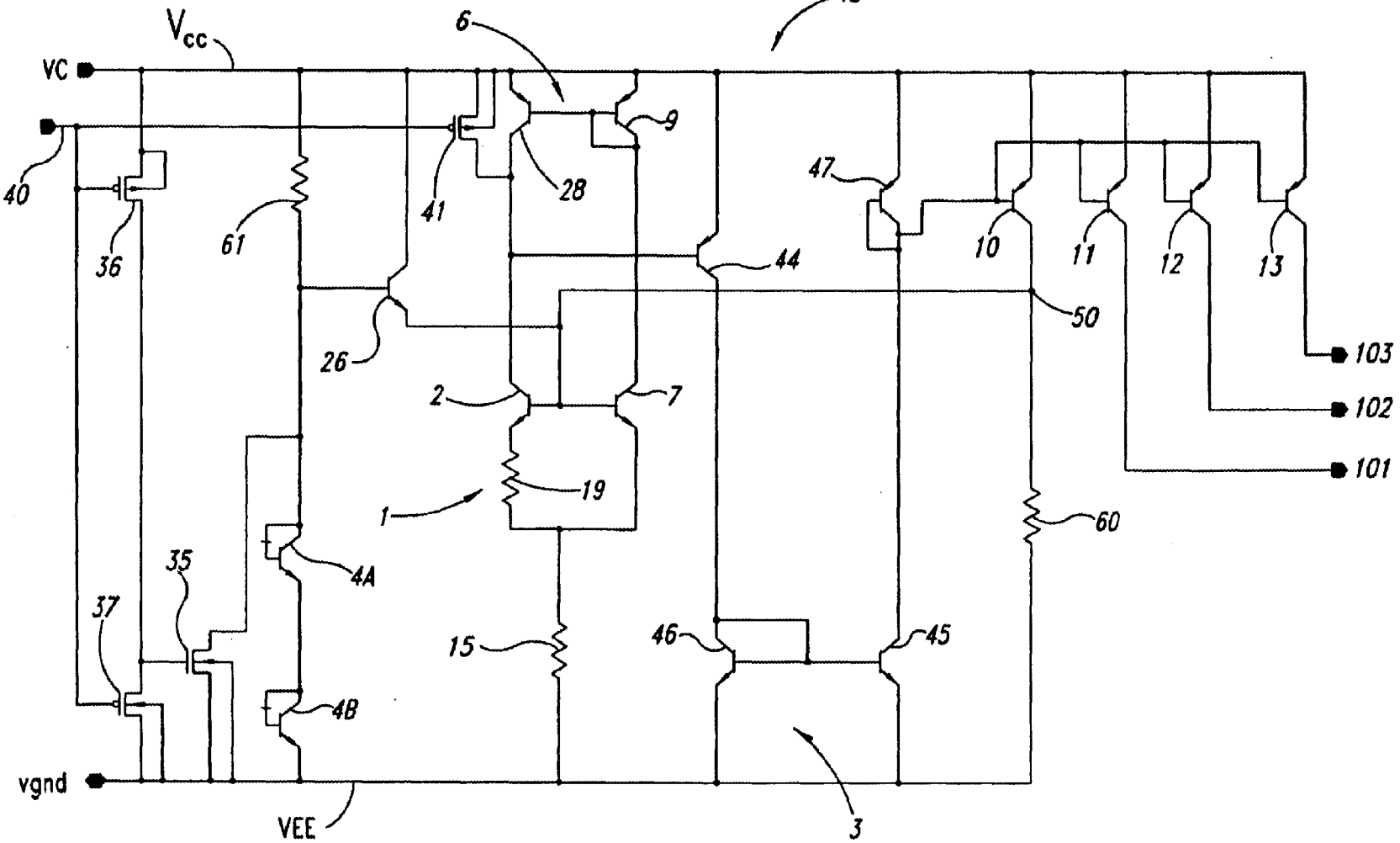
103
102
101
13
12
11
10
50
60
48
47
45
3
44
46
9
7
28
19
6
41
2
15
1
26
4A
4B
VEE
61
Vcc
35
36
37
VC
40
vgnd

CURRENT SOURCE

BACKGROUND OF THE INVENTION

1. Field of the Invention

The present invention relates to a current source circuit using a bandgap voltage circuit.

2. Description of the Related Art

Current sources using bandgap voltage circuit are known in the art for example from U.S. Pat. No. 5,581,174.

BRIEF SUMMARY OF THE INVENTION

The present invention provides embodiments which have improved power supply rejection and which allow for turning on and off the current generator in a simple manner. Further embodiments allow for multiple current outputs.

According to an embodiment of the present invention there is provided a current source having a sensing transistor and a bandgap circuit having first and second control transistors and a current mirror, the sensing transistor having a control electrode and a main current path, the main current path being connected to a feedback resistance at a first node, the other end of the feedback resistance being at a reference potential, each of the first and second control transistors having respective control electrodes, respective emitters and respective collectors, the first node being connected to the control electrodes of the first and second control transistors, the emitter of the first control transistor coupled to the reference potential via a first resistance and the emitter of the second control transistor coupled to the emitter of the first control transistor via a second resistance, the current mirror having a diode-connected transistor and a controlled transistor, the diode connected transistor connecting the collector of the first control transistor to a power rail and the controlled transistor connecting the collector of the second control to the power rail, the bandgap circuit being dimensioned to provide a first potential across said feedback resistance, characterised by a current amplifier having an input and an output, the input being connected to the collector of the second control transistor and the output being connected to the control electrode of the sensing transistor.

Preferably the first and second control transistors are of a first conductivity and the current mirror transistors are of a second opposite conductivity and wherein the current amplifier has a first amplifying transistor of said second conductivity having a control electrode connected to the collector of the second control transistor and a collector connected to the input of a second current mirror, said second current mirror comprising transistors having said first conductivity coupled to said reference potential.

Advantageously said second current mirror has an output connected to a diode-connected transistor of said second conductivity type, said output being further connected to the control electrode of said sensing transistor.

Conveniently the controlled transistor of the said current mirror has a first width and the amplifying transistor has a greater width.

Preferably the current source further comprises a start up circuit for the bandgap, the stare up circuit having a pull-up transistor for pulling said first node up to a second potential having a lesser magnitude than the first potential.

Advantageously said pull-up transistor is an emitter follower of said first conductivity and has a base connected to a voltage source comprising plural series diodes.

Conveniently said base is further connected to a switch for selectively shorting said diodes in response to a control signal.

Conveniently again said switch is an n FET.

Preferably said start up circuit further comprises a clamping transistor connected to the collector of the second transistor for selectively turning off said first amplifying transistor in response to said control signal.

Advantageously said clamping transistor is a p FET.

Preferably said switch is an n FET, and said start up circuit further comprises a p FET connected to the collector of the second transistor for selectively turning off said first amplifying transistor in response to said control signal, the current source having a control terminal for receiving a first voltage level operable to turn off said current source and a second voltage level operable to start said current source, said control terminal being connected to a control electrode of the p FET and to the gate of the n FET via an inverter.

Preferably again the current source has a plurality of second conductivity type output transistors, each having an emitter connected to said power supply rail, a base connected to the control electrode of the sensing transistor, wherein each of said output transistors has a collector providing a respective current output.

Advantageously at least one of said output transistors has greater width than another of said output transistors whereby said at least one output transistor provides a higher output current.

BRIEF DESCRIPTION OF THE DRAWING

A preferred but exemplary embodiment of the invention will now be described with reference to the accompanying FIGURE which shows a schematic diagram of a current source in accordance with the invention.

DETAILED DESCRIPTION OF THE INVENTION

The current source of the embodiment consists of a bandgap circuit 1 which has a first NPN bipolar transistor 2 having a base connected in common to that of a second NPN bipolar transistor 7. The first bipolar transistor 2 has a greater effective width that the second transistor 7, for example five times greater. The effect is that for a similar base-emitter potential the first transistor 2 will conduct more current than the second transistor 7. The emitter of the first transistor 2 is connected to the emitter of the second transistor 7 via a resistance 19 and the emitter of the second transistor 7 is connected to a reference potential VEE via a resistance 15.

The collectors of the first 2 and second 7 NPN transistors are connected to a positive supply rail Vcc via a current mirror 6 composed of PNP transistors 9,28. The second NPN transistor 7 has its collector connected to the positive supply rail Vcc via a diode-connected PNP transistor 9 which has its base connection in common with a controlled PNP transistor 28 serving to connect the collector of the first NPN transistor 2 to the positive supply rail Vcc. The collector of the first NPN transistor 2 is further connected to the base of a first amplifying PNP transistor 44 which has an emitter connected to the positive supply rail and a collector connected to a second current mirror 3. The second current mirror 3 has a first NPN transistor 46 which is diode-connected, and which has an emitter connected to the reference rail VEE. The base of transistor 46 is connected in common to the base of a controlled NPN transistor 45, with emitter connected to the reference rail VEE and with a collector connected to a diode-connected PNP transistor 47 and the emitter of transistor 47 connected to the positive supply rail. Together the transistors 44–47 form a current amplification circuit 48. To provide current gain the first amplifying transistor 44 is wider than the controlled transistor 28 of the first current mirror 6, for example twice as wide. In the preferred embodiment transistors 45, 46 and 47 are of the same size as transistor 28.

The collector of transistor 45 is also connected to the base of a sensing transistor 10, being a PNP transistor having its emitter connected to the positive supply rail Vcc. The collector of transistor 10 is connected to the reference rail VEE via a feedback resistor 60, the node 50 between the transistor 10 and the resistor 60 being connected to the commoned bases of the first and second NPN transistors 2, 7.

In operation the bandgap circuit, being connected in a loop including the current amplifier and the feedback resistor, provides a constant potential at the node 50. The constant potential at node 50 is produced by virtue of a constant current through the sensing transistor 10 and the base potential of the sensing transistor 10 is thus such as to give rise to this constant current. The base potential is fed to three output PNP transistors 11, 12, 13, each of which has a respective emitter connected to the positive supply rail and a respective collector forming an output node 101, 102, 103. In the embodiments shown transistor 11 and 12 are each twice the width of transistor 10 and transistor 13 is four times the width of transistor 10. As a result output terminals 101 and 102 each produce a magnitude of current double that of the current through transistor 10 whereas the node 103 produces a current four times the magnitude of the current through transistor 10.

The current source circuit has a high power supply rejection, defined as the amount of variation of power supply voltage which appears in the output current. The power supply rejection at the output, which depends upon the power supply rejection at node 50 is the ratio of the output resistance of the sensing transistor 10 to the feedback resistance 60 divided by the loop gain of the circuit. Given that the node 50 is in the feedback loop and given the gain of the loop including the current amplifying circuit a theoretical value of power supply rejection of minus 78 dB may be achieved in embodiments of the invention.

The circuit so far defined is unlikely to be self-starting. To achieve self-starting it is necessary to cause the bandgap circuit 1 to start to conduct. To achieve this an NPN emitter follower transistor 26 has its emitter connected to the commoned bases of the first and second NPN transistors 2 and 7. The collector of the emitter follower 26 is connected to the positive supply rail Vcc and the base is connected to the positive supply rail Vcc via a resistor 61. The base is further connected to the reference rail VEE via the series connection of two diode-connected NPN transistors 4A and 4B. A switch in the form of an N-FET 35 has its main current path connected between the base of emitter follower transistor 26 and the reference supply rail VEE and the FET has a gate connection to the output of a CMOS inverter having a P-type pull-up transistor 36 and an N-type pull-down transistor 37. The gates of the transistors 36 and 37 are connected in common to a control terminal 40 which is also connected to a P-type transistor 41 having its main current path between the positive supply rail Vcc and the collector of the second NPN transistor 2.

The operation of the start-up circuitry will now be described:

When the control terminal 40 is at a high potential the gate of the switch 35 is at a low potential and therefore the switch 35 remains non-conducting. In this situation current flows through the resistor 61 to the series connection of the diodes 4A and 4B causing a base potential on the emitter follower 26 of two diode voltages above the reference potential. Hence the emitter of the emitter follower 26 will have a potential of one diode voltage above the reference potential and this value is fed to the commoned gates of the first and second NPN transistors of the bandgap circuit 1, this potential being sufficient to start the bandgap. Once the bandgap loop is operational the potential at the node 50 is higher than one diode potential above the reference rail and as a result the emitter follower 26 plays no part in the normal operating mode.

The P-type transistor 41 constitutes a control for turning off the current source.

During the start-up condition the high potential at the control terminal 40 maintains the P-transistor 41 off, therefore not affecting operation of the bandgap. When however the potential at the control terminal 40 falls towards the reference level, the P-type transistor 41 turns on and pulls the collector of the second NPN transistor 2 of the bandgap towards the positive supply potential. This in turn causes the current amplifying transistor 44 to turn off and turns off the bandgap loop. At the same time the low potential at control terminal 40 is supplied to the inverter 36, 37 and the N-type switch 35 turns on shorting out the diodes 4A and 4B and reducing the base voltage of the emitter follower 26 to substantially zero.

The constant current circuit described produces a constant current output over temperature and supply voltage. It is turned on and off easily and the control circuitry for starting and stopping operation has no substantial effect on operation.

All of the above U.S. patents, U.S. patent application publications, U.S. patent applications, foreign patents, foreign patent applications and non-patent publications referred to in this specification and/or listed in the Application Data Sheet, U.S. Pat. No. 5,581,174 are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. A current source, comprising:

a sensing transistor having a control electrode and a main current path;

a bandgap circuit having first and second control transistors and a first current mirror, each of the first and second control transistors having respective control electrodes, respective emitters and respective collectors, the first current mirror having a diode-connected transistor and a controlled transistor, the diode-connected transistor connecting the collector of the first control transistor to a power rail and the controlled transistor connecting the collector of the second control transistor to the power rail;

a feedback resistance having a first end connected to the main current path at a first node, and a second end at a reference potential, the first node being connected to the control electrodes of the first and second control transistors;

a first resistance coupling the emitter of the first control transistor to the reference potential;

a second resistance coupling the emitter of the second control transistor to the emitter of the first control transistor, the bandgap circuit being dimensioned to provide a first potential across said feedback resistance; and a current amplifier having an input and an output, the input being connected to the collector of the second control transistor and the output being connected to the control electrode of the sensing transistor.

2. The current source of claim 1, wherein the first and second control transistors are of a first conductivity and the first current mirror transistors are of an opposite, second conductivity and wherein the current amplifier has:

an amplifying transistor of said second conductivity having a control electrode connected to the collector of the second control transistor and a collector; and a second current mirror comprising an input connected to the collector of the amplifying transistor, and transistors having said first conductivity coupled to said reference potential.

3. The current source of claim 2, wherein said second current mirror has an output connected to a diode-connected transistor of said second conductivity type, said output of said second current mirror being further connected to the control electrode of said sensing transistor.

4. The current source of claim 2 wherein the controlled transistor of said first current mirror has a first width and the amplifying transistor has a second width greater than the first width.

5. The current source of claim 2, further comprising a start up circuit for the bandgap circuit, the start up circuit having a pull-up transistor for pulling said first node up to a second potential having a lesser magnitude than the first potential.

6. The current source of claim 5 wherein said pull-up transistor is an emitter follower of said first conductivity, and has a base connected to the power rail through a resistor and to the reference potential through plural series diodes.

7. The current source of claim 6 wherein said base is further connected to a switch for selectively shorting said series diodes in response to a control signal.

8. The current source of claim 7 wherein said switch is an n FET.

9. The current source of claim 7 wherein said start up circuit further comprises a clamping transistor connected to the collector of the second control transistor for selectively turning off said amplifying transistor in response to said control signal.

10. The current source of claim 9 wherein said clamping transistor is a p FET.

11. The current source of claim 7, wherein said switch is an n FET, wherein said start up circuit further comprises a p FET connected to the collector of the second control transistor for selectively turning off said amplifying transistor in response to said control signal, the current source having a control terminal for receiving a first voltage level operable to turn off said current source and a second voltage level operable to start said current source, said control terminal being connected to a control electrode of the P FET and to a gate of the n FET via an inverter.

12. The current source of claim 11 having a plurality of second conductivity type output transistors, each having an emitter connected to said power rail, a base connected to the control electrode of the sensing transistor, wherein each of said output transistors has a collector providing a respective current output.

13. The current source of claim 12 wherein at least one of said output transistors has greater width than another of said output transistors whereby said at least one output transistor provides a higher output current.

14. The current source of claim 13, wherein said first voltage level received by said control terminal is low such that said amplifying transistor causes said output transistors and the bandgap circuit to be turned off while at the same time said low first voltage level causes said n FET and said inverter to turn off said pull-up transistor.

15. The current source of claim 14, wherein said first voltage level is such that the p FET is turned on, pulling the control electrode of said amplifying transistor to said power rail and thereby turning said amplifying transistor off, wherein since no current can conduct the output transistors are turned off.

16. The current source of claim 14, wherein at said first voltage level said inverter causes the n FET to turn on thereby shorting out said plural series diodes and pulling the base of said pull-up transistor low to thereby turn off said pull-up transistor.

17. A current source, comprising:

a bandgap circuit that includes first and second control transistors each having a first conduction terminal connected to a first voltage reference, a second conduction terminal connected to a second voltage reference, and a control terminal, the control terminals being connected to each other;

a sensing transistor having a control terminal and a main current path between first and second conduction terminals;

a feedback resistance connected between the second conduction terminal of the sensing transistor and the second voltage reference; and a current amplifier connected between the first conduction terminal of the first control transistor and the control terminal of the sensing transistor, the current amplifier including:

an amplifier transistor having a main current path, and a control terminal connected to the first conduction terminal of the first control transistor; and a current mirror having a first mirror leg in series with the main current path of the amplifier transistor, and a second mirror leg coupled to the control terminal of the sensing transistor.

18. The current source of claim 17, further comprising a diode-connected transistor connected between the first voltage reference and the second mirror leg, and to the control electrode of the sensing transistor.

19. The current source of claim 17, further comprising a start up circuit that includes:

a first and second resistances; and a pull-up transistor connected between the first voltage reference and a node connecting the sensing transistor to feedback resistance, the pull-up transistor having a control terminal connected to the first voltage reference through the first resistance and to the second voltage reference through the second resistance.

20. The current source of claim 19, further comprising a switch connected between the control terminal of the pull-up transistor and the second voltage reference for selectively shorting the second resistance in response to a control signal.

21. The current source of claim 19 wherein the start up circuit further comprises a clamping transistor connected to the first conduction terminal of the first control transistor for selectively turning off the amplifying transistor in response to a control signal.

22. A current source, comprising:

a bandgap circuit that includes first and second control transistors each having a first conduction terminal connected to a first voltage reference, a second conduction terminal connected to a second voltage reference, and a control terminal, the control terminals being connected to each other;

a sensing transistor having a control terminal and a main current path between first and second conduction terminals;

a feedback resistance connected between the second conduction terminal of the sensing transistor and the second voltage reference;

a current amplifier connected between the first conduction terminal of the first control transistor and the control terminal of the sensing transistor; and a startup circuit that includes:

a first startup transistor connected between the first reference voltage and the second conduction terminal of the sensing transistor, the first startup transistor having a control terminal responsive to a control node; and a second startup transistor connected between the first reference voltage and the first conduction terminal of the first control transistor, the second startup transistor having a control terminal responsive to the control node, the second startup transistor being structured to conduct when the first startup transistor is non-conductive.

23. The current source of claim 22 wherein the current amplifier includes:

an amplifier transistor having a main current path, and a control terminal connected to the first conduction terminal of the first control transistor; and a current mirror having a first mirror leg in series with the main current path of the amplifier transistor, and a second mirror leg coupled to the control terminal of the sensing transistor.

* * * * *